US009188312B2

(12) United States Patent
Yoder et al.

(10) Patent No.: US 9,188,312 B2
(45) Date of Patent: Nov. 17, 2015

(54) OPTICAL SYSTEM FOR A DIRECTIONAL LAMP

(71) Applicant: GE Lighting Solutions, LLC, East Cleveland, OH (US)

(72) Inventors: Benjamin Lee Yoder, Cleveland Heights, OH (US); Lei Deng, Solon, OH (US); David Christopher Anderson, Willoughby, OH (US); Dengke Cai, Willoughby, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 45 days.

(21) Appl. No.: 13/802,987

(22) Filed: Mar. 14, 2013

(65) Prior Publication Data

US 2014/0268796 A1 Sep. 18, 2014

(51) Int. Cl.
*F21V 7/00* (2006.01)
*F21V 13/04* (2006.01)
(Continued)

(52) U.S. Cl.
CPC ..... *F21V 13/04* (2013.01); *F21V 7/0025* (2013.01); *F21V 29/505* (2015.01); *F21V 29/70* (2015.01); *F21K 9/137* (2013.01); *F21Y 2101/02* (2013.01)

(58) Field of Classification Search
CPC ..... F21V 29/004; F21V 7/04; F21V 7/0025; F21V 7/41; F21V 7/0058; F21V 7/09; F21V 29/505; F21V 29/74; F21V 29/76; F21V 29/77; F21V 7/0008; F21V 7/0083; F21V 1/00; F21V 3/00; F21Y 2101/02; F21Y 2101/00; F21Y 2103/003; F21Y 2105/001; F21S 8/02; F21S 48/1305; F21S 48/1323; F21S 48/137; F21S 48/1341; F21S 48/1388; F21S 8/026; F21S 8/04; F21S 8/06; F21W 2131/10
USPC ..... 362/244–247, 249.01, 249.02, 294, 362/297, 302, 311.01, 311.02, 326–328, 362/345, 373, 540, 544–546
See application file for complete search history.

(56) References Cited

U.S. PATENT DOCUMENTS 1,562,347 A * 11/1925 Libson ..... 362/255
1,903,417 A * 4/1933 Audley ..... 362/304
(Continued)

FOREIGN PATENT DOCUMENTS

CN 101545609 9/2009
EP 2199658 A1 6/2010
(Continued)

OTHER PUBLICATIONS

PCT Search Report and Written Opinion issued Apr. 24, 2014 in connection with corresponding PCT Patent Application No. PCT/US2014/017622.
(Continued)

*Primary Examiner* — Hargobind S Sawhney
(74) *Attorney, Agent, or Firm* — GE Global Patent Operation; Peter T. DiMauro

(57) ABSTRACT

A directional lamp assembly includes a light source, a reflector having a first portion and a second portion and operative to direct light emitted from the light source to a target area, a heat sink circumscribing the reflector and operative to dissipate heat produced by the light source and a light diffusing lens disposed over the light source and operative to transmit light to the target area. The second portion of the reflector is disposed radially outboard of the first portion and is integrally formed in combination with the heat sink.

19 Claims, 3 Drawing Sheets

(51) Int. Cl.

| | |
|---|---|
| ***F21V 29/505*** | (2015.01) |
| ***F21V 29/70*** | (2015.01) |
| *F21K 99/00* | (2010.01) |
| *F21Y 101/02* | (2006.01) |

(56) References Cited

U.S. PATENT DOCUMENTS

| | | | | |
|---|---|---|---|---|
| 2,149,109 | A * | 2/1939 | Welch | 362/303 |
| 3,705,302 | A * | 12/1972 | Judge et al. | 362/222 |
| 4,472,767 | A * | 9/1984 | Wenman | 362/302 |
| 4,761,721 | A * | 8/1988 | Willing | 362/348 |
| 4,907,044 | A * | 3/1990 | Schellhorn et al. | 257/98 |
| 4,926,293 | A * | 5/1990 | Saba | 362/96 |
| 6,644,841 | B2 * | 11/2003 | Martineau | 362/545 |
| 6,739,737 | B2 * | 5/2004 | Yu | 362/300 |
| 7,387,409 | B1 * | 6/2008 | Beadle | 362/329 |
| 7,488,096 | B2 | 2/2009 | Childers et al. | |
| 7,497,596 | B2 * | 3/2009 | Ge | 362/294 |
| 7,762,693 | B2 * | 7/2010 | Chu et al. | 362/329 |
| 8,622,591 | B1 * | 1/2014 | Liu et al. | 362/373 |
| 2004/0114366 | A1 * | 6/2004 | Smith et al. | 362/247 |
| 2004/0136038 | A1 | 7/2004 | Holmes et al. | |
| 2005/0168702 | A1 | 8/2005 | Koegler et al. | |
| 2008/0093620 | A1 | 4/2008 | Lee et al. | |
| 2010/0254128 | A1 | 10/2010 | Pickard et al. | |
| 2010/0259919 | A1 | 10/2010 | Khazi et al. | |
| 2011/0103066 | A1 | 5/2011 | Teather | |
| 2011/0181167 | A1 | 7/2011 | Cho et al. | |
| 2011/0193479 | A1 * | 8/2011 | Nilssen et al. | 315/35 |
| 2011/0215345 | A1 * | 9/2011 | Tarsa et al. | 257/88 |
| 2013/0286646 | A1 * | 10/2013 | Snell | 362/231 |
| 2014/0254154 | A1 * | 9/2014 | Catalano | 362/243 |

FOREIGN PATENT DOCUMENTS

| | | | |
|---|---|---|---|
| WO | 2005124452 | A1 | 12/2005 |
| WO | 2006105072 | A2 | 10/2006 |
| WO | 2011125010 | A1 | 10/2011 |
| WO | 2013006239 | A2 | 1/2013 |

OTHER PUBLICATIONS

Dunay et al, "Polycarbonate components simplify LED lamp design", LEDs Magazine, May 2012.

Teather et. al, "Low-Cost, Highly Lambertian Reflector Composite for Improved LED Fixture Efficiency and Lifetime", WhiteOptics LLC, DOE SSL R&D Workshop. Feb. 2, 2011.

* cited by examiner

OPTICAL SYSTEM FOR A DIRECTIONAL LAMP

FIELD

The aspects of the present disclosure relate generally to optical systems and in particular to a reflector assembly for a light engine employing a chip-on-board (COB) light emitting diode (LED).

DESCRIPTION OF RELATED ART

Directional lamps are generally employed in commercial and residential buildings to illuminate areas within the space, such as office and living spaces, with a high intensity, focused beam of light. Such lamps are particularly useful and cost efficient for lighting large office spaces inasmuch as they may be selectively situated where illumination is desired. This is in contrast to omnidirectional lights, which generally light an entire area or space, whether or not illumination is required. In addition to selective positioning, directional lamps are oftentimes mounted flush, or recessed, relative to the ceiling structure to produce a streamlined, aesthetically-pleasing appearance. While directional lighting provides a variety of benefits and functions, the directional and mounting requirements can create several design challenges and difficulties, which heretofore have not been satisfactorily met.

It is generally desired to configure a directional lamp such that light is cast broadly without diminishing the intensity of light in a target area. One of the criteria for such directional lamps, taken from the Energy Star requirements for integral LED lamps, is that at least eighty percent (80%) of the light energy falls within a defined angular region or boundary with the remainder being scattered beyond the boundary. To achieve this degree of directionality, lamps of the prior art typically include a reflector having a parabolic or hyperbolic shape. In lamp reflectors with this shape or contour, the light disposed at a focal point of the reflector will be dispensed as a collimated beam of directed light, also referred to as a beam of parallel light energy. This is in contrast to a conventional incandescent light bulb, which generates a scattered array of light energy.

In addition to focusing light energy within a select area, it is generally desired that a directional lamp should radiate a soft, optically-pleasing, beam of light. While a parabolic or hyperbolic reflector shape for a directional lamp, as discussed in the preceding paragraph, can be used for directing light, this shape will tend to produce a high intensity beam of light, which can be disagreeable to the eyes of a user. Furthermore, an array of lamps employing such reflectors may require a high density of lights, i.e., a plurality of closely spaced lamps, to provide uniform coverage within an optical environment. As a result, more power, i.e., wattage, is required to illuminate a space along with an attendant increase in cost.

A directional lamp must dissipate a relatively large quantity of heat inasmuch as nearly seventy percent (70%) of the electrical energy used to illuminate the lamp is converted to heat. It will be appreciated that the space constraints imposed by a recessed mount can restrict or limit the paths available for heat dissipation. Accordingly, a proper heat sink must be provided.

It would be advantageous to provide an optical system that casts a wide, soft, i.e., optically-pleasing, emission of light and provides an efficient path for heat dissipation, while being optically and cost efficient.

Accordingly, it would be desirable to provide a light engine that resolves at least some of the problems identified above.

SUMMARY OF THE INVENTION

As described herein, the exemplary embodiments overcome one or more of the above or other disadvantages known in the art.

One aspect of the present disclosure relates to a directional lamp assembly. In one embodiment the directional lamp assembly includes a light source, a reflector having a first portion and a second portion and operative to direct light emitted from the light source to a target area, a heat sink circumscribing the reflector and operative to dissipate heat produced by the light source and a light diffusing lens disposed over the light source and operative to transmit light to the target area, wherein the second portion of the reflector is disposed radially outboard of the first portion and is integrally formed in combination with the heat sink.

Another aspect of the present disclosure relates to a reflector for a directional lamp assembly having a light engine for producing a source of light, a heat sink operative to dissipate heat produced by the light source, and a lens cover operative to transmit light to a target area. In one embodiment, the reflector includes a first reflector portion having an aperture for accepting the light engine and having a first conical surface defining a cone angle $\theta$, a second reflector portion disposed in combination with, and radially outboard of the first reflector portion and having a second conical surface defining a cone angle $\beta$, the second conical surface integrally formed in combination with the heat sink.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

In the drawings.

Where applicable, like reference characters designate identical or corresponding components and units throughout the several views, which are not to scale unless otherwise indicated.

DETAILED DESCRIPTION OF THE DISCLOSED EMBODIMENTS

Figure 1:
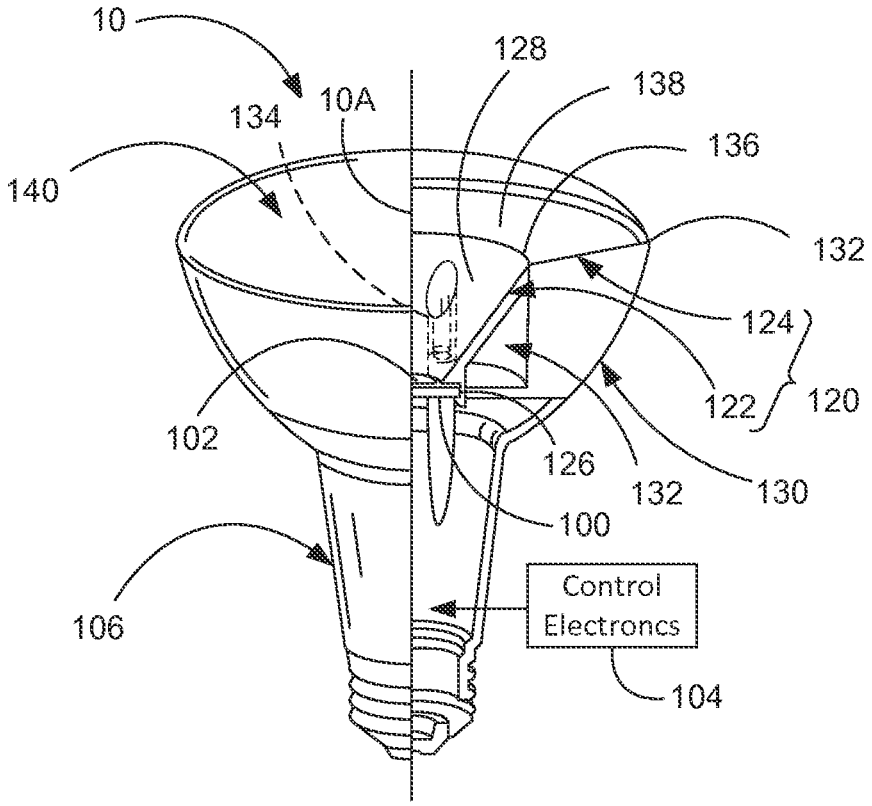
FIG. 1 illustrates a broken-away side perspective view of one embodiment of an optical system for a directional lamp assembly incorporating aspects of the present disclosure.

Referring to FIG. 1, one embodiment of a directional light assembly incorporating aspects of the present disclosure is generally indicated by reference number 10. The aspects of the disclosed embodiments are generally directed to a directional light assembly 10 that includes a source of light 102, a reflector 120, a heat sink 130 circumscribing the light source 102, and a light diffusing lens 140 disposed over the light source 102. In one embodiment, the reflector 120 is configured to direct light produced by the light source 102 to a target area (not shown). The light diffusing lens 140 is configured to produce a substantially uniform distribution of light across the target area.

In one embodiment, the reflector 120 includes a first portion 122 and a second portion 124. As is illustrated in the embodiment of FIG. 1, the second portion 124 of the reflector 120 is disposed radially outboard of the first portion 122 relative to a longitudinal axis of symmetry 10A, and is integrally formed with an upper portion of the heat sink 130. In one embodiment, the first portion 122 of the reflector 120 includes an aperture 126 for accepting a light engine 100. The heat sink 130 supports the first portion 122 of the reflector 120 and integrally forms the second portion 124 thereof to augment the dissipation of heat produced by the light source 102. The light diffusing lens 140 interacts with the light generated by the light source 102, and which is reflected from the first and second portions 122, 124 of the reflector 120, to transmit light to a target area.

The light engine 100 comprises single light source 102 such as light emitting diode (LED). In one embodiment, the light engine 102 comprises a chip-on-board (COB) light emitting diode. While the aspects of the disclosed embodiments are generally described herein in the context of a light engine 100 comprising a single chip-on-board light emitting diode, any one of a variety of light sources may be employed in a directional light assembly 10 incorporating aspects of the present disclosure. For example, the directional light assembly 10 may include an array of LEDs, or other sources of solid state lighting such as Organic Light Emitting Diodes (OLEDs) and Polymer Light Emitting Diodes (PLEDs). Consequently, it will be appreciated that the disclosure herein is merely exemplary of one embodiment of the directional light assembly 10 system and should be broadly interpreted in view of the appended set of claims.

In the embodiment shown in FIG. 1, the light engine 100 is disposed within the heat sink 130 and is powered by control electronics 104. The control electronics 104 illustrated in FIG. 1 are housed within the lower end cap 106 of the directional lamp assembly 10.

As noted above, the first portion 122 of the reflector 120 includes aperture 126 for accepting the light engine 100 and, more particularly, the light source 102. In one embodiment, the first portion 122 is also configured to secure the light engine 100 to the heat sink 130 thereby producing a first path of heat dissipation, i.e., a path for dissipating the heat produced by the light source 102. Furthermore, the first portion 122 is disposed within a cavity 132 of the heat sink 130 and is secured thereto by several axial posts 134, illustrated in FIGS. 1 and 2, disposed along the underside of the first portion 122.

Figure 2:
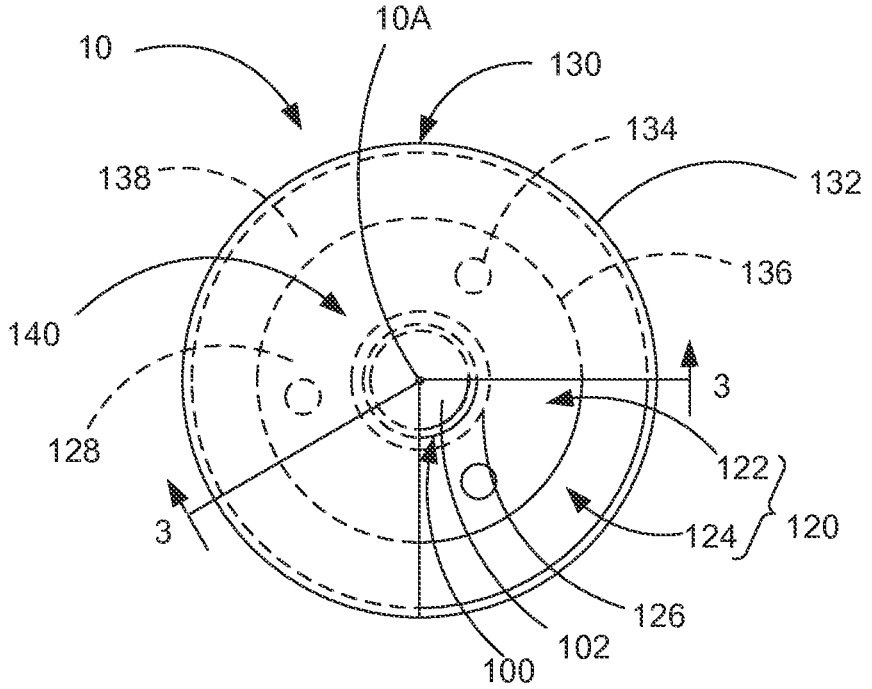
FIG. 2 is a broken-away top view of the directional lamp assembly depicted in FIG. 1.

Referring to FIGS. 1 and 2, in the described embodiment, the first reflector portion 122 defines a first conical surface 128 generally having the shape of a frustum, which diverges away from the light source 102. More specifically, the first conical surface 128 is arranged such that the smaller sectioned-end of the frustum defines the aperture 126 for accepting the light producing element 102. The larger sectioned-end of the frustum, or base, is contiguous with an edge 136 of the cavity 132.

The second portion 124 of the reflector 120 is disposed radially outboard of the first portion 122 and defines a second conical surface 138. As is shown in FIGS. 1 and 2, the second conical surface 138 is radially outboard of the first conical surface 128, relative to the central longitudinal axis of symmetry 10A. The second conical surface 138 generally has the shape of a frustum, which diverges away from the light source 102.

Figure 3:
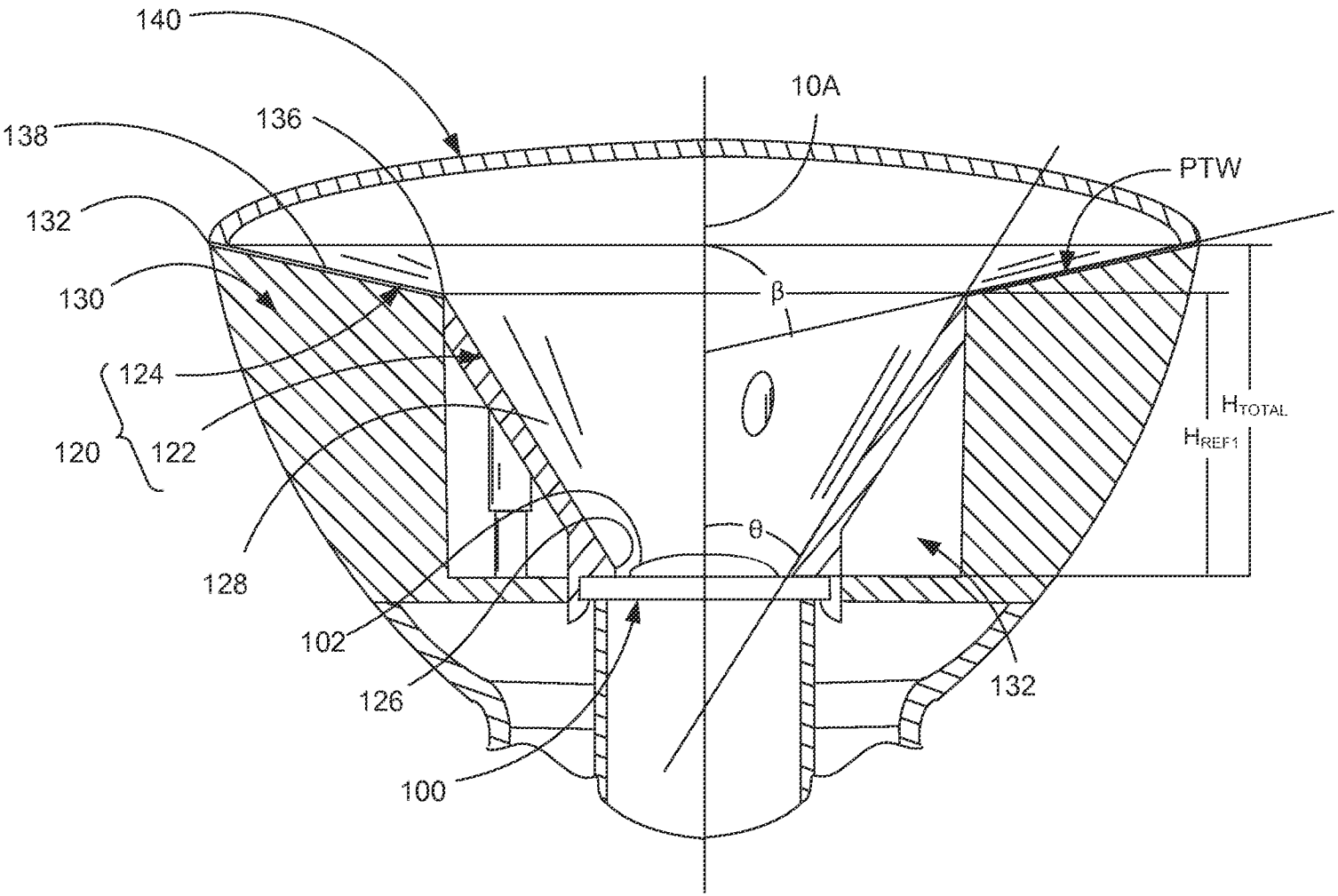
FIG. 3 is an enlarged sectional view of the directional lamp assembly taken substantially along line 3-3 of FIG. 2.

Referring to FIG. 3, the first conical surface 128 defines a cone angle θ within a range of between about twenty-eight degrees (28°) to about thirty-eight degrees (38°). The second conical surface 138 defines a cone angle β within a range of between about eighty degrees (80°) to about ninety degrees (90°). In one embodiment, the second conical surface 138 diverges at an angle β, which is approximately more than twice the angular inclination of the first conical surface 128. As a result, there is no direct "line of sight" from the light source 102 to the second conical surface 138, and the light re-directed by the second conical surface 138 must first interact with, or be diverted from, the light diffusing lens 140. That is, while a portion of the light is initially transmitted through the light diffusing lens 140, another portion of the light is reflected back into the directional lamp assembly 10 toward, for example, the second conical surface 138. As a consequence, light is re-directed from the second conical surface 138 toward and through the light diffusing lens 140 such that a softer, more uniform, distribution of light is produced.

To understand this effect, one may view a first portion of light from the light source 102 as being directed or reflected by the first conical surface 128 and transmitted to a first portion of the target area. Furthermore, another portion of light from the light source 102, which interacts with the light diffusing lens 140, is re-directed back, or downwardly toward the second conical surface 138. The light is then reflected by the second conical surface 138 and transmitted, once again toward the diffusing lens 140. In the second, or subsequent iterations of reflection of the light, the light is transmitted through the lens 140, but toward a second, larger portion, of the target area. As a consequence, the angled configuration of the first and second conical surfaces 128, 138, also referred to as a stepped configuration, effects a softer, more uniform distribution of light.

Referring to FIG. 3, the second reflector portion 124 is integrally formed in combination with the heat sink 130. The integration of the second reflector portion 124 with the heat sink 130 provides a second path for heat dissipation, the first path of heat dissipation being established by the first reflector portion 122. Depending upon the surface area of the second reflector portion 124, this second path may be the dominant, or principal, path for heat dissipation. In addition to establishing a path for heat dissipation, the integration of the second reflector portion 124 with the heat sink 130 reduces the overall number of component parts associated with the directional light assembly 10, and the cost associated therewith.

In the described embodiment, the first reflector portion 122 is fabricated from a polycarbonate material. A suitable polycarbonate material is sold under the trademark Panlite® manufactured by Teijin Chemicals LTD. headquartered in Norcross, Ga., USA. The second reflector portion 124 is fabricated by depositing a reflective powder coating (PTW) on the second conical surface 138 of the heat sink 130, i.e., the surface between the outer peripheral edge 132 of the heat sink 130 and the peripheral edge 136 of the cavity 134. A suitable powder coating is available under the tradename PTW90135 from Valspar Corporation headquartered in Minneapolis, Minn., USA. In the described embodiment, the powder coating PTW is applied electrostatically and is subsequently cured under heat, i.e., in an oven or autoclave. Furthermore, the powder may be a thermoplastic or thermoset polymer material. Inasmuch as a coating is bonded or fused directly to the surface of the heat sink 140, there is little "contact loss" in connection with conductive heat transfer. As a result, the configuration offers a highly efficient solution for heat transfer and dissipation.

The light diffusing lens 140 generally comprises a polycarbonate resin matrix having a reflective particulate suspended therein. More specifically, resin matrix of the light diffusing lens 140 is loaded with a particulate having a density, (i.e., the concentration of particulate material as a percent of the total mass of the lens), of less than, or equal to about, ten percent (10%). Furthermore, the suspended particles typically have size less than or equal to about twenty (20) microns in diameter.

Figure 4:
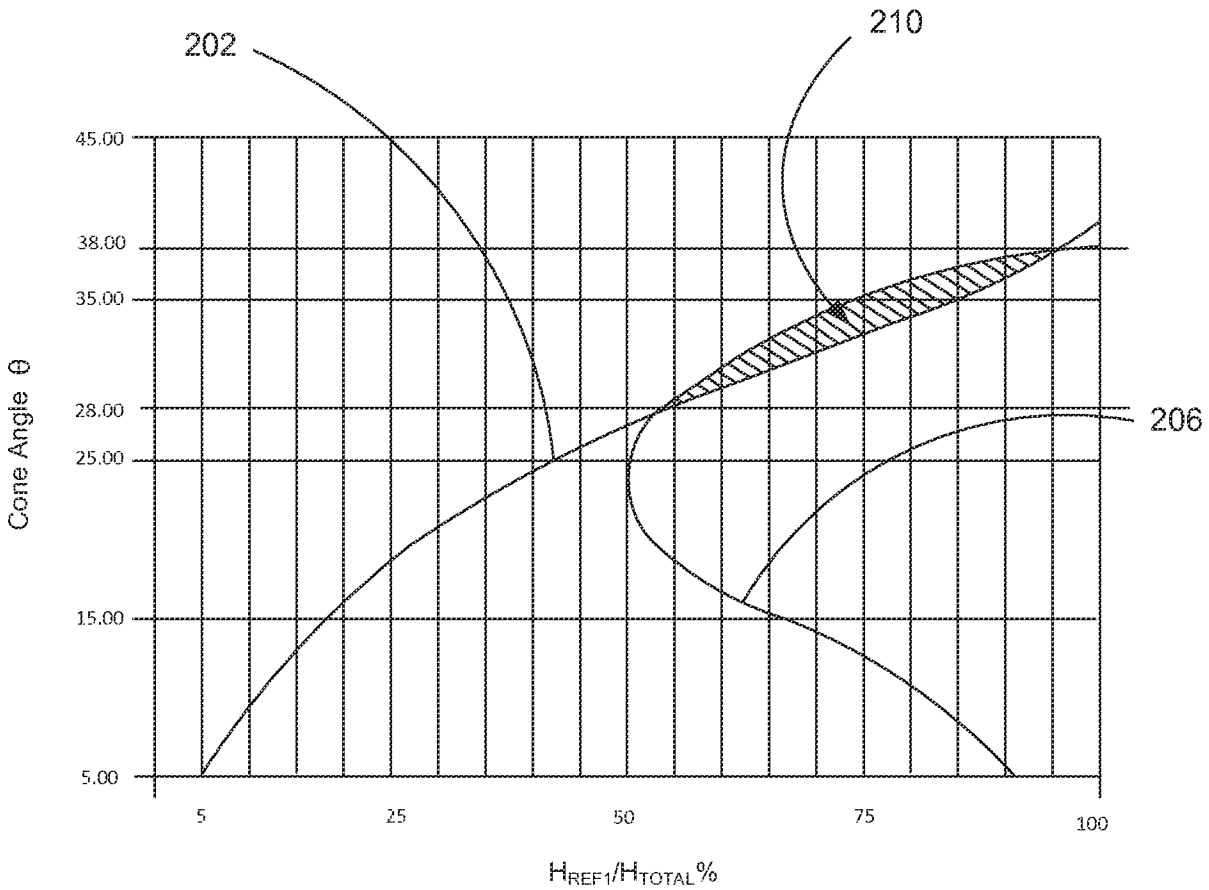
FIG. 4 is a plot of optical efficiency and light distribution contours as a function of the cone angle and height ratio of one embodiment of a conically-shaped reflector assembly incorporating aspects of the present disclosure.

FIG. 4 is a graph depicting optical efficiency and light distribution curves or contours for two different types of reflectors. The curves 202, 206 are plotted as a function of the "cone angle", i.e. angle θ as seen in FIG. 3, along the Y-axis, and the ratio of the height ($H_{REF1}$) of the first reflector portion 122 to the total height ($H_{TOTAL}$) of the first and second reflector portions 122, 124 (i.e., the "height ratio") along the X-axis. The height values are measured from the base plane of the respective conical frustum to the upper sectional plane of the same conical frustum. When plotted on the same graph, the curves 202, 206 produce a region of overlap 210. The region of overlap 210 generally defines the optimized characteristics of the reflector 120 incorporating aspects of the present disclosure. In this region of overlap 210, the optical efficiency of the reflector 120 will be greater than approximately 89% while ensuring that at least 80% of the transmitted light will fall into a target area or region of interest, which can also be described as a solid angle of it steradians.

The first curve 202 is for a conically-shaped reflector attaining an optical efficiency of greater than approximately 89%. As illustrated in FIG. 4, the optical efficiency of the reflector represented by first curve 202 tends to increase as the height ratio $H_{REF1}/H_{TOTAL}$ decreases, where any point above the first curve 202 represents design space in which the optical efficiency is greater than 89%. For example, looking at a cone angle of 25 degrees, as one moves from right to left along this line (i.e. decreasing height ratio) it can be seen that you go from being below the 89% contour (i.e. <89% optical efficiency) to above the 89% contour (i.e. >89% optical efficiency).

The second curve 206 is for a conically-shaped reflector that is configured to direct approximately 80% of the transmitted light into a solid angle of π steradians, i.e., into a desired target area. The percentage of light within the target area for the reflector represented by second curve 206 increases as the height ratio $H_{REF1}/H_{TOTAL}$ increases such that an acceptable value is reached where the ratio of $H_{REF1}/H_{TOTAL}$ equals approximately 50%, depending on the cone angle. Therefore, points to the right of the curve 206 represent optimized parameters of cone angle and height ratios for the reflector 120 of the disclosed embodiments. As a result, a region of overlap 210 is identified which represents combinations of cone angle θ and height ratio $H_{REF1}/H_{TOTAL}$ which effect optimum optical efficiency and light distribution for a reflector 120 incorporating aspects of the present disclosure. The region of overlap 210 identifies that a cone angle θ within a range of between about twenty-eight degrees (28°) to about thirty-eight degrees (38°) meets the optical efficiency and light distribution requirements.

In summary, the aspects of the present disclosure provide an optical system in the form of a directional light assembly which projects or emits a wide, soft, i.e., optically-pleasing, beam of light energy. This is achieved by the use of a reflector 120 having at least two reflector sections 122, 124, also referred to as a stepped reflector, in combination with a light diffusing lens or cover 140. The optical system of the present disclosure provides an efficient path for heat dissipation by integrating a second portion of the reflector with the heat sink to improve the thermal properties of the optical system.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit and scope of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A directional lamp assembly, comprising:

a light source comprising an array of LEDs;

a reflector having a first portion and a second portion and operative to direct light emitted from the light source to a target area;

a heat sink circumscribing the reflector and operative to dissipate heat produced by the light source; and a light diffusing lens disposed over the light source and operative to transmit light to the target area;

wherein the second portion of the reflector is disposed radially outboard of the first portion and is integrally formed in combination with the heat sink;

wherein the first portion of the reflector includes a first conical surface defining a cone angle θ, wherein the second portion of the reflector includes a second conical surface defining a cone angle β, the cone angle β being greater than the cone angle θ; wherein the heat sink circumscribes the light source and includes a first peripheral edge for attaching the light diffusing lens, and a second peripheral edge for accepting the first portion of the reflector.

2. The directional lamp assembly according to claim 1, wherein the first portion of the reflector comprises a reflective polycarbonate material.

3. The directional lamp assembly according to claim 1, wherein the second portion of the reflector comprises a reflective powder coating disposed over a portion of the heat sink.

4. The directional lamp assembly according to claim 1, wherein the first portion of the reflector secures a portion of the light source to the heat sink to define a first path for heat dissipation.

5. The directional lamp assembly according to claim 4, wherein the second portion of the reflector in combination with the heat sink defines a second path for heat dissipation.

6. The directional lamp assembly according to claim 1, wherein the light diffusing lens interacts with the light produced from the light source such that a portion of the light is transmitted through the lens to illuminate a first portion of a target area and another portion of the light is re-directed from the second portion of the reflector and transmitted through the lens to illuminate a second portion of the target area.

7. The directional lamp assembly according to claim 6, wherein an area of the second portion of the target area is larger than an area of the first portion of the target area.

8. The directional lamp assembly according to claim 1, wherein the heat sink circumscribes the light source and includes a first peripheral edge for attaching the light diffusing lens, and a second peripheral edge for accepting the first portion of the reflector.

9. The directional lamp assembly according to claim 8, wherein a surface disposed between the first and second peripheral edges is coated by the reflective powder coating to define the second portion of the reflector.

10. The directional lamp assembly according to claim 1, wherein the cone angle β is at least twice a magnitude of the cone angle θ.

11. The directional lamp assembly according to claim 1, wherein the first portion of the reflector includes a first conical surface defining a cone angle θ, the cone angle θ being within a range of between about twenty-eight degrees (28°) to about thirty-eight degrees (38°).

12. The directional lamp assembly according to claim 11, wherein the second portion of the reflector includes a second conical surface defining a cone angle β, the cone angle β being within a range of between about eighty degrees (80°) to about ninety degrees (90°).

13. A directional lamp assembly having a light engine for producing a source of light, a heat sink operative to dissipate heat produced by the light source, a lens cover operative to transmit light to a target area, and a reflector, the reflector comprising:

a first reflector portion having an aperture for accepting the light engine and having a first conical surface defining a cone angle θ;

a second reflector portion disposed in combination with, and radially outboard of the first reflector portion and having a second conical surface defining a cone angle β, the second conical surface integrally formed in combination with the heat sink; wherein the heat sink circumscribes the light source and includes a first peripheral edge for attaching the lens cover, and a second peripheral edge for accepting the first portion of the reflector.

14. The reflector according to claim 13, wherein the cone angle θ is within a range of between about twenty-eight degrees (28°) to about thirty-eight degrees (38°).

15. The reflector according to claim 13, wherein the cone angle β is at least twice a magnitude of the cone angle θ.

16. The reflector according to claim 13, wherein the first reflector portion is fabricated from a reflective polycarbonate material.

17. The reflector according to claim 13, wherein the cone angle β is greater than the cone angle θ.

18. A directional lamp assembly having a light engine for producing a source of light, a heat sink operative to dissipate heat produced by the light source, a lens cover operative to transmit light to a target area, and a reflector, the reflector comprising:

a first reflector portion having an aperture for accepting the light engine and having a first conical surface defining a cone angle θ being within a range of between about 28° to about 38°;

a second reflector portion disposed in combination with, and radially outboard of the first reflector portion and having a second conical surface defining a cone angle β, the second conical surface integrally formed in combination with the heat sink, wherein the second portion of the reflector comprises a reflective powder coating disposed thereover;

wherein the cone angle β is greater than the cone angle θ; wherein the heat sink circumscribes the light source and includes a first peripheral edge for attaching the light diffusing lens, and a second peripheral edge for accepting the first portion of the reflector.

19. The reflector according to claim 18, wherein the cone angle β is within a range of between about eighty degrees (80°) to about ninety degrees (90°).

* * * * *